US011262082B2

(12) United States Patent
Crudo et al.

(10) Patent No.: US 11,262,082 B2
(45) Date of Patent: Mar. 1, 2022

(54) UP-AND-DOWN HOOD

(71) Applicant: FABER S.p.A., Fabriano (IT)

(72) Inventors: Alexander Giuseppe Crudo, Sigillo (IT); Andrea Rapisarda, Turin (IT); Francesco Faginoli, Fabriano (IT); Andrea David Caracini, Fabriano (IT)

(73) Assignee: FABER S.p.A., Fabriano (IT)

( * ) Notice: Subject to any disclaimer, the term of this patent is extended or adjusted under 35 U.S.C. 154(b) by 385 days.

(21) Appl. No.: 16/385,354

(22) Filed: Apr. 16, 2019

(65) Prior Publication Data

US 2019/0316786 A1 Oct. 17, 2019

(30) Foreign Application Priority Data

Apr. 16, 2018 (IT) ..... 102018000004522

(51) Int. Cl.
*F24C 15/20* (2006.01)

(52) U.S. Cl.
CPC ..... *F24C 15/2085* (2013.01); *F24C 15/2071* (2013.01)

(58) Field of Classification Search
CPC ..... F24C 15/2071; F24C 15/2085
USPC ..... 454/66
See application file for complete search history.

(56) References Cited

U.S. PATENT DOCUMENTS

2007/0079823 A1 4/2007 Shin
2017/0292717 A1 10/2017 Crudo et al.
2017/0356673 A1* 12/2017 Gauss ..... F04D 29/703

FOREIGN PATENT DOCUMENTS

CN 107435958 12/2017
EP 3045822 7/2016
EP 3045822 A1 * 7/2016 ..... F24C 15/2085
EP 3228942 10/2017
WO 2009018679 2/2009

* cited by examiner

*Primary Examiner* — Allen R. B. Schult
(74) *Attorney, Agent, or Firm* — Volpe Koenig

(57) ABSTRACT

An extraction hood of the up-and-down type for extracting fumes and/or vapours generated on a hob includes a fixed first hood portion (2) and a second extraction hood portion (4) set at a distance from the first extraction hood portion (2) and close to the hob, the second hood portion containing an extraction device (6) capable of drawing in air containing fumes and/or vapours from the hob and directing it towards an opening (11) in the second hood portion (4) to be discharged therefrom and passed towards the first hood portion (2). A conveyor (10) for the discharged air is provided at the opening (11) of the second hood portion (4). The conveyor includes a body (30) having a tubular annular shell (31) containing a honeycomb structure (32) with a number of tubular cells (42) through which the air leaving the second hood portion (4) is discharged.

10 Claims, 8 Drawing Sheets

UP-AND-DOWN HOOD

INCORPORATION BY REFERENCE

The following documents are incorporated herein by reference as if fully set forth: Italian Patent Application No. 10 2018 000004522, filed Apr. 16, 2018.

BACKGROUND

The present invention relates to a kitchen extraction hood of the up-and-down type.

Hoods of the above-mentioned type usually include a portion capable of being placed next to a hob where fumes and/or vapours requiring extraction are generated and another fixed portion placed above such hob and attached to a ceiling or support above such hob. This fixed portion may project from the ceiling or be recessed into it, as in EP3045822.

For convenience the portion attached to or inserted in the ceiling will be referred to as the "first portion" and the portion next to the hob will be referred to as the "second portion".

The two portions, which may also move relative to each other, are connected by a plurality of cables supporting the second portion; if the second portion can move with respect to the first these cables are subject to the action of an actuating element which unwinds them from a supporting element to allow the second portion to be lowered towards the hob and lifted from such hob.

For example, a hood of the above-mentioned type is the object of a prior European patent application EP3228942 by the same applicant.

Due to the fact that in comparison with fixed hoods the second portion is close to the hob, a hood of the above-mentioned type is better able to extract the fumes and/or vapours generated during food preparation on such hob; in the case of the second movable portion, this closeness is only achieved when the extraction function is required.

Known hoods of the above type transfer the extracted air (with fumes and/or vapours) from the hob from the second portion to the first portion. Here, the filtered air is expelled from the environment where the hob is located or is returned to said environment. However, it is important that there should be optimum transfer of the extracted air from the second to the first portion, avoiding it being dispersed into the environment before reaching the first hood portion.

In addition, there is also the problem of ensuring that the air drawn in by the second hood portion is effectively and efficiently expelled from the first hood portion through an extraction unit or fan attached to that first portion.

Finally, there is also the problem of reducing turbulence in the air flow entering the first hood portion to reduce the noise generated during use of the extraction hood.

SUMMARY

The object of the present invention is to provide an extraction hood of the above-mentioned type that is improved in comparison with similar already known hoods.

Another object is to provide an extraction hood of the above-mentioned type that has an excellent extraction capacity and a high degree of reliability in transferring the air drawn in from the second to the first portion with little or no dispersion into the environment when passing from the second portion to the first.

A further object is to provide a hood of the type mentioned that is silent in operation.

These and other objects which will be evident to those skilled in the art are accomplished through an extraction hood of the up-and-down type having one or more features of the invention as described below and in the claims.

BRIEF DESCRIPTION OF THE DRAWINGS

For a better understanding of the present invention, there are attached, purely by way of example but not limited thereto, the following figures, in which.

DETAILED DESCRIPTION

Figure 1:
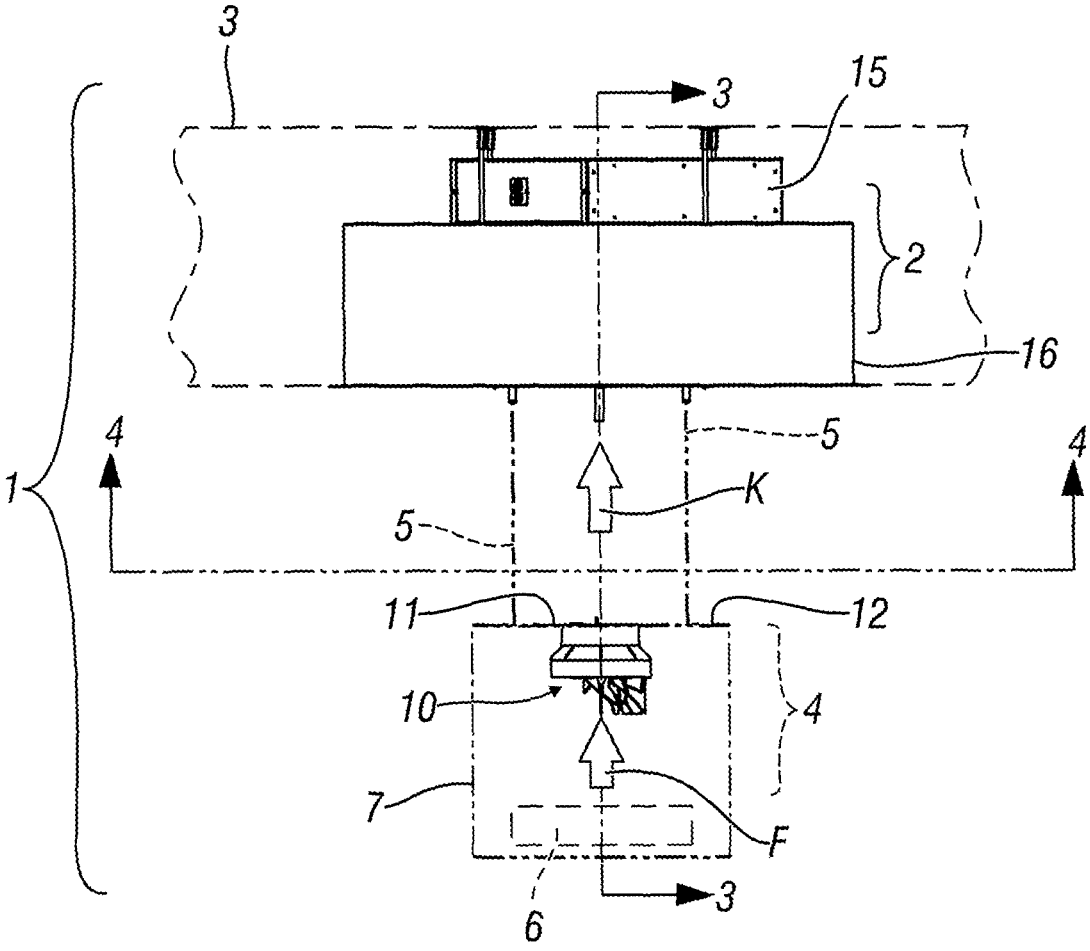
FIG. 1 shows a diagrammatical side view of an extraction hood according to the invention in a position of use.

In the figures, corresponding parts are indicated using the same reference numbers.

With reference to the figures mentioned, an extraction hood according to the invention is generically indicated by 1. Such hood is of the known up-and-down type and comprises a first portion 2, attached to a ceiling 3 of an environment where there is a hob (not shown and above which the aforementioned hood is placed), and a second portion 4 which is capable of being placed near the aforementioned hob when the hood is in use. Such second portion may be fixed at a predefined distance from first portion 2 or second portion 4 may move with respect to the first so that the distance between these portions can be altered (for example, by bringing second portion 4 close to the hob when food is being prepared and moving such second portion 4 away from the hob when it is not in use).

First portion 2 and second portion 4 are connected to each other by cables 5. There is no air pipe or duct between the two portions and, in the case of second portion 4 which can move with respect to the first, the usual motor-driven cable winders 5 associated with the first portion or ceiling 3 cause second hood portion 4 to be lifted from and/or lowered towards the hob. First portion 2 can be fixed to ceiling 3 or can be inserted therein, or be retractable (as in FIG. 1). Second portion 4 comprises the usual extraction device 6 to extract air from a hob below, said hob not being shown.

Figure 2:
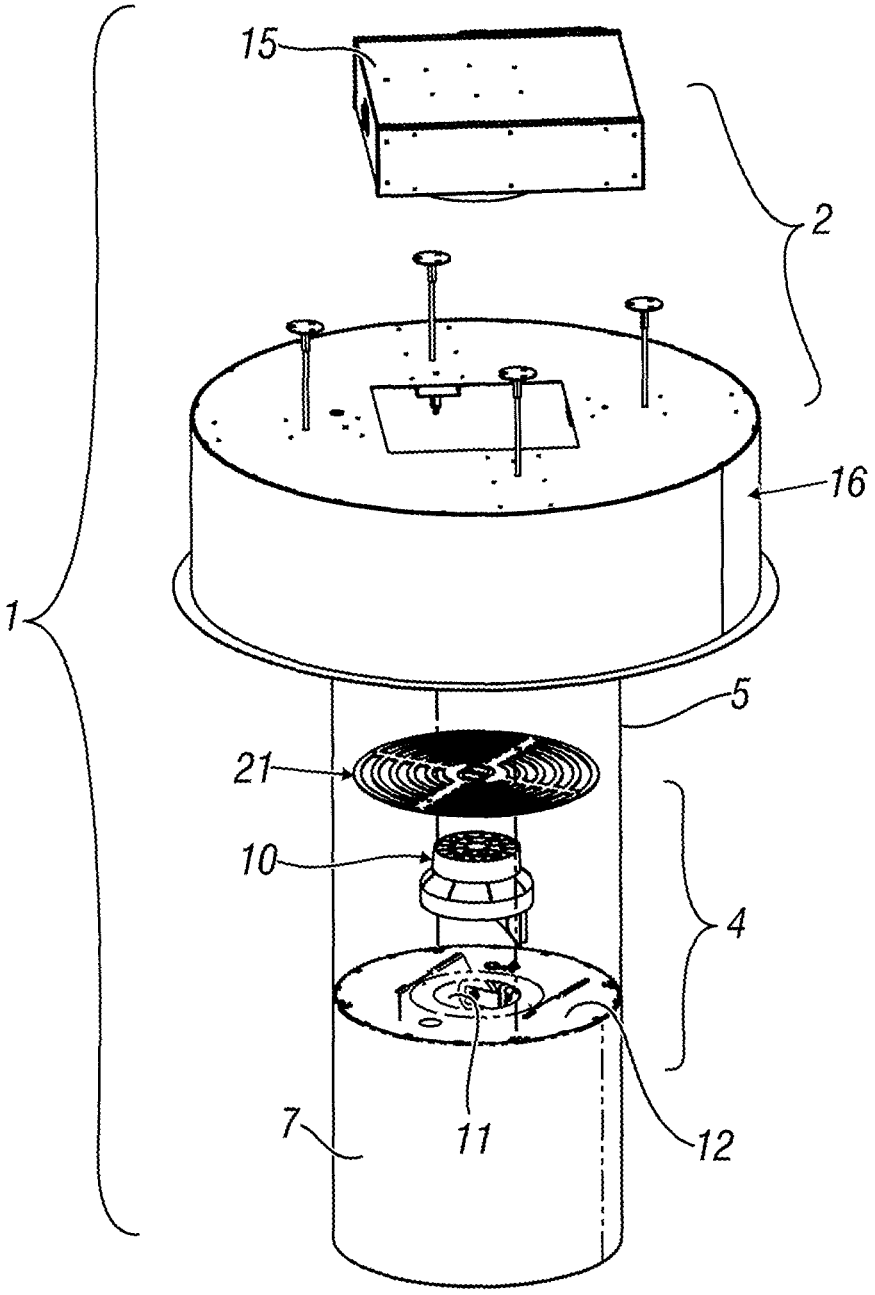
FIG. 2 shows an exploded perspective view of the hood in FIG. 1.
Figure 3:
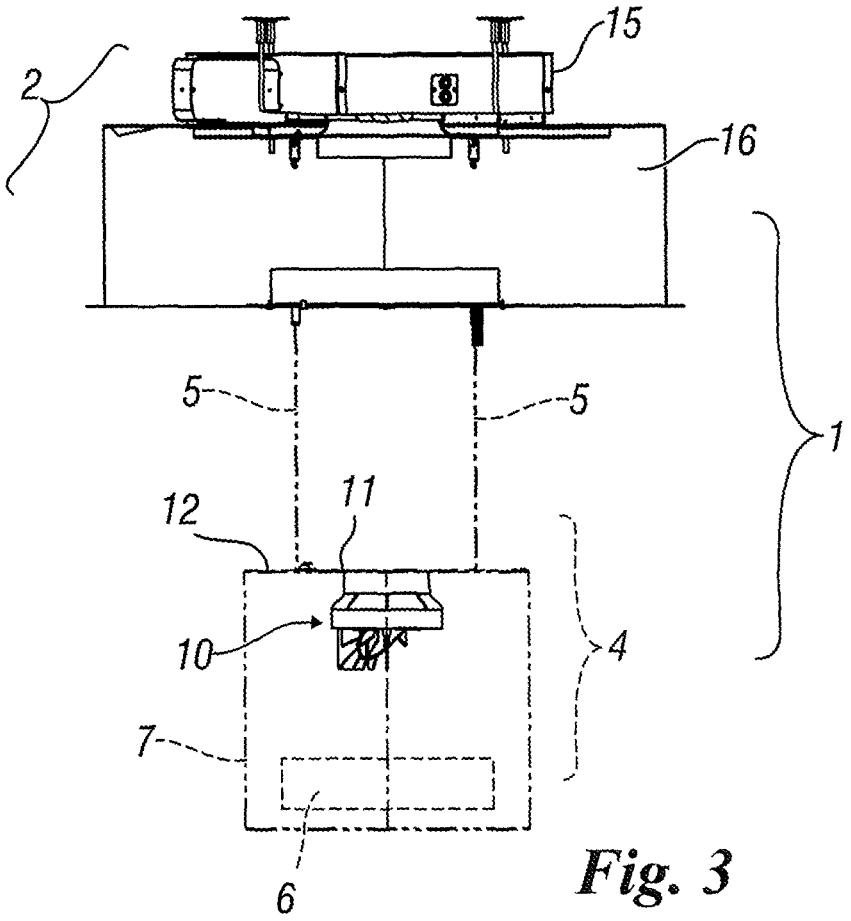
FIG. 3 shows a cross-sectional view along the line 3-3 in FIG. 1 with some parts omitted for clarity.
Figure 4:
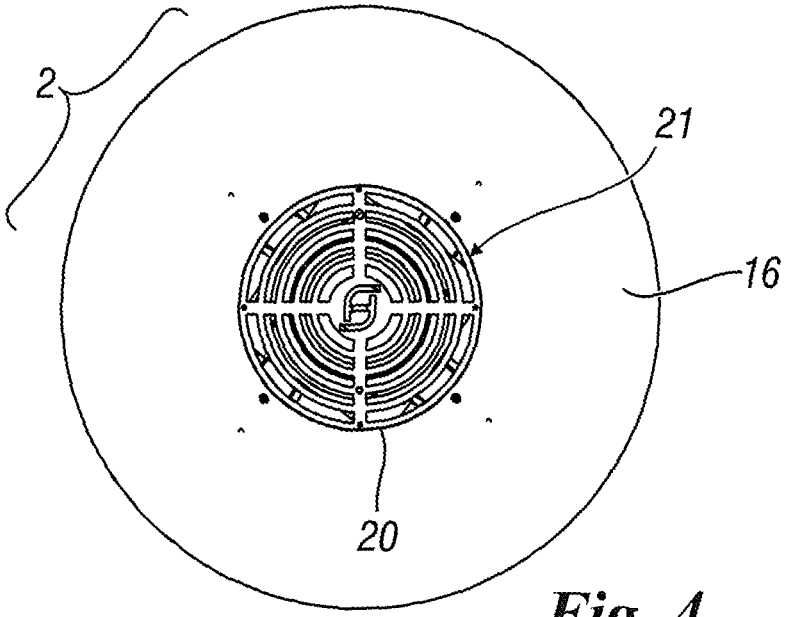
FIG. 4 shows a cross-sectional view along the line 4-4 in FIG. 1.
Figure 5:
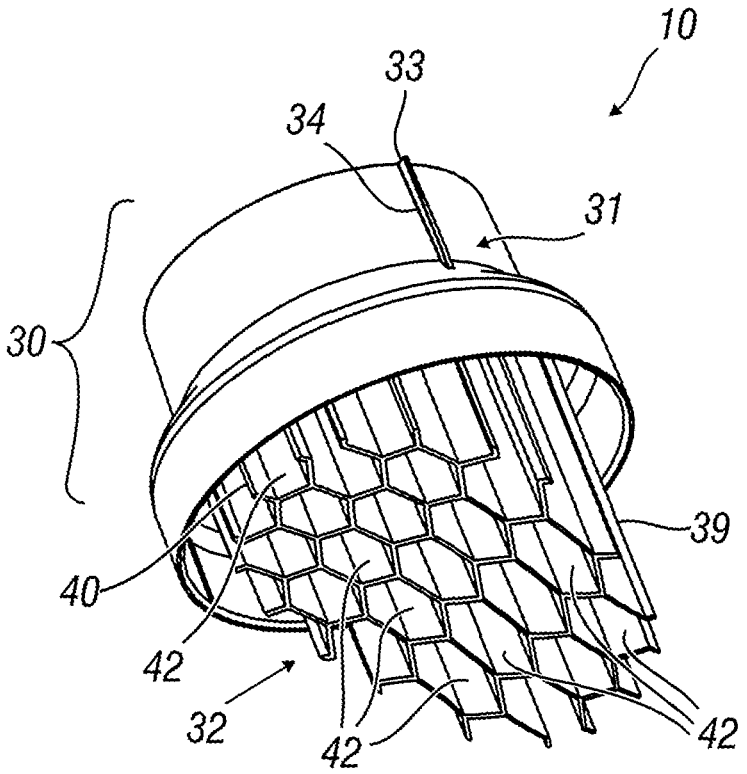
FIG. 5 shows a perspective view of a component of the extraction hood in FIG. 1.
Figure 6:
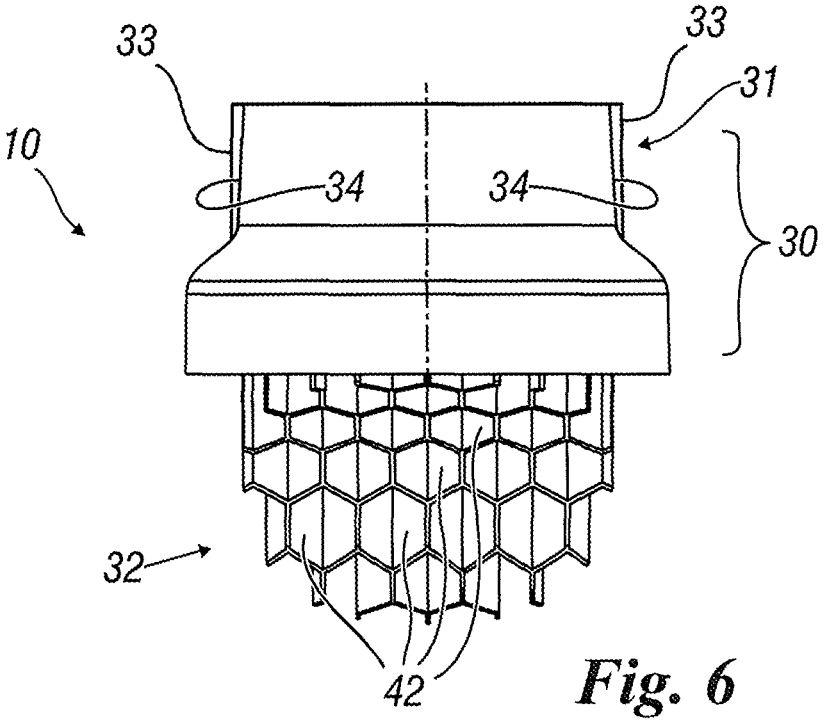
FIG. 6 shows a view from one side of the component in FIG. 5.
Figure 7:
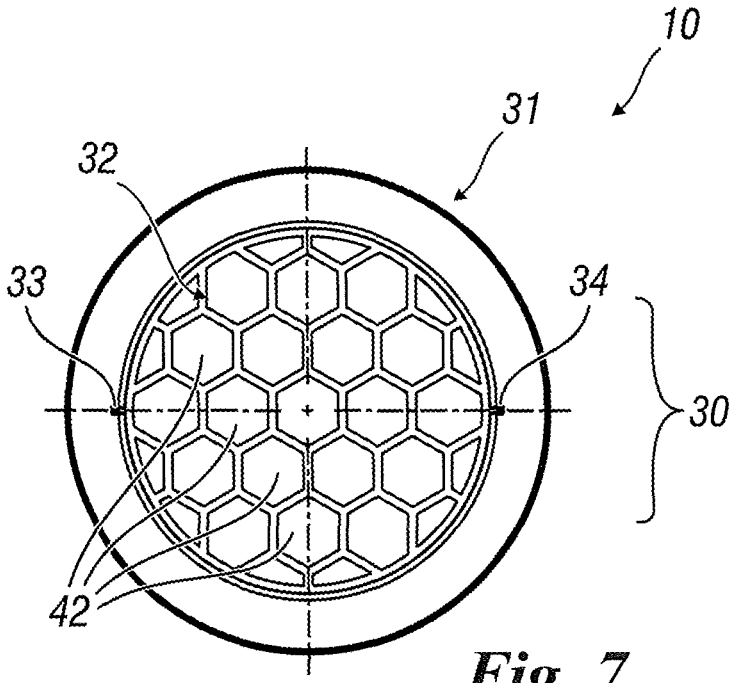
FIG. 7 shows a top view of the component in FIG. 5.

The extraction device 6 is placed within a body 7 of portion 4 that may be of any shape; in FIGS. 1-3 second portion 4 is of cylindrical shape, but is not however limited to that shape. Part 4 comprises the usual other parts of an extraction hood, such as filters, grilles and any lighting elements. These parts are known in themselves and are not indicated in the figures.

Finally, body 7 of hood portion 4 has the usual and known ducts for the passage of extracted air towards a component 10 (which will be described below) capable of directing the extracted air (with the fumes and/or vapours) from the hob towards first hood portion 2.

Extraction device 6 (a fan) is able to extract the fumes and/or vapours generated on the hob thanks to the fact that second portion 4 is placed at a relatively short distance from the hob. The extracted fumes and/or vapours are usually conveyed (arrow F in FIG. 1), after having been filtered through a usual filter (not shown) present in body 7, into a duct that transfers them to component 10 placed at an opening 11 at one end 12 of portion 4 facing first portion 2. This component 10 acts to convey air towards first hood portion 2.

The air leaving component or conveyor 10 (arrow K in FIG. 1) is directed towards first portion 2 and is extracted by an auxiliary fan 15 externally associated with a hollow body 16 of first portion 2 of hood 1 fixed to ceiling 3. Fan 15 is connected to an exhaust duct outside the environment where the hood is located; it has a high extraction power (for example between 600 and 1200 $m^3/h$) preferably higher than that of extraction means or fan 6 associated with second portion 4 of hood 1. This enables the air conveyed by component 10 to be quickly drawn in by first portion 2 of hood 1. From this portion 2 the air is expelled into a duct (not shown) through which fumes and/or vapours drawn from the hob are transferred to an environment outside the kitchen.

The body 16 of first portion 2 is completely hollow and serves as a "stilling chamber" for the extracted air. This body 16 holds the air drawn from second portion 4 before it is completely extracted by fan 15 and expelled from the hood. The body 16 can receive the air drawn in from second portion 4, substantially entirely, thanks to the action of component or conveyor 10. The air coming from this component enters body or stilling chamber 16 through its opening 20, where there is a grille 21, facing second hood portion 4.

In order to have optimum "transfer" of the extracted air from second portion 4 of the hood to first portion 2, component or conveyor 10 is of a particular shape: it comprises a body 30 having an external annular shell 31 delimiting a space in which there is a honeycomb structure 32. Such structure is preferably separate and connected to shell 31, for example through lateral tabs 33 acting together with seats 34 provided in the shell.

Once assembled, body 30 (including shell 31 and structure 32) is inserted into portion 4 of hood 1 at opening 11 in a known way.

FIGS. 5-16 show various embodiments of component or conveyor 10.

Figure 8:
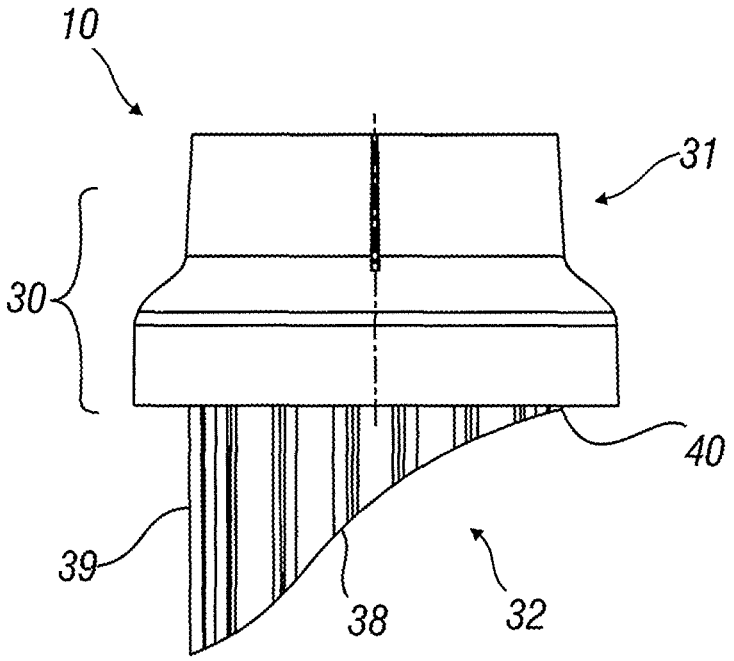
FIG. 8 shows a view from another side of the component in FIG. 5.

According to a first embodiment shown in FIGS. 5-8, component or conveyor 10 has a honeycomb structure 32 of asymmetrical shape with a free surface 38 having a curved course (see FIG. 8). This structure 32 has a first lateral side 39 that projects more from shell 31 towards the inside of second portion 4 of hood 1 and a second lateral side 40 that ends substantially within shell 31.

In other words, honeycomb structure 32 comprises a plurality of tubular cells 42 of polygonal cross-section, open at their ends, of different lengths, passing from first side 39 to the second side. Ideally structure 32 takes the form of a honeycomb body (defined by tubular cells 42) of cylindrical shape but cut by a wavy surface having the course of free surface 38.

In this way, as mentioned above, tubular cells of different lengths are created, helping to direct the air extracted from the hob (and moved by fan device 6) towards second hood portion 2.

Figure 9:
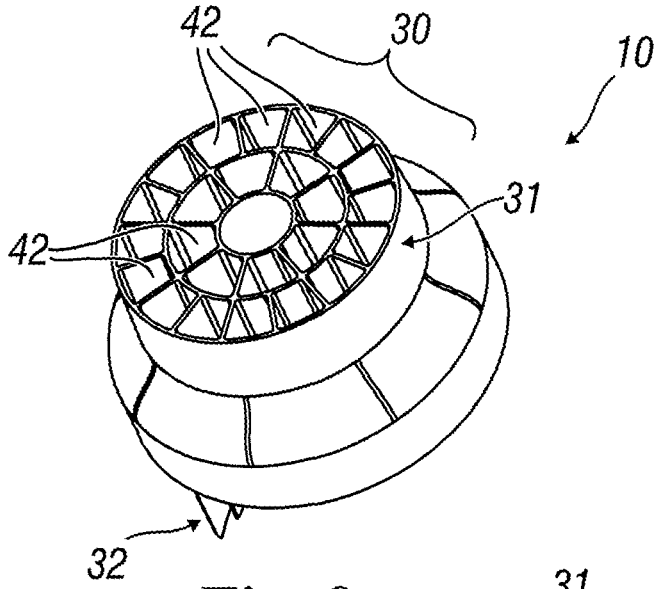
FIG. 9 shows a perspective view of a variant of the component in FIG. 5.
Figure 10:
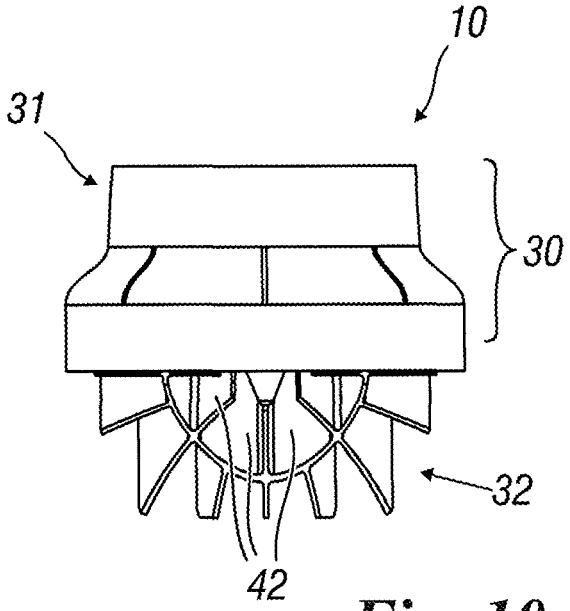
FIG. 10 shows a view from one side of the component in FIG. 9.
Figure 11:
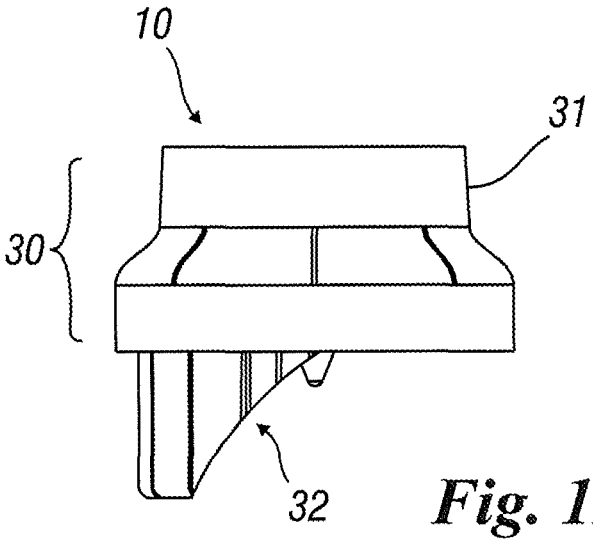
FIG. 11 shows a view from another side of the component in FIG. 9.

The second embodiment of component and conveyor 10 (provided only as an example, but not limited thereto) is shown in FIGS. 9-11; here honeycomb structure 32 is still present, but with fewer tubular cells 42 than the solution in FIGS. 5-8. This structure has a shape which projects less from shell 31 than that in FIGS. 5-8, and is made of one piece with shell 31 (for example by injection moulding).

Figure 12:
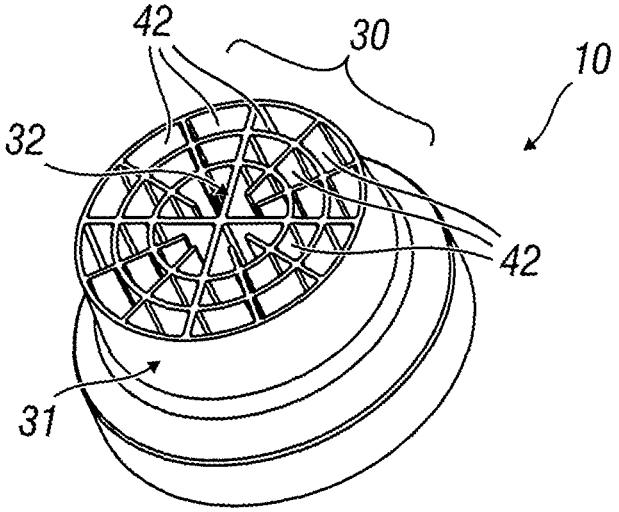
FIG. 12 shows a perspective view of another variant of the component in FIG. 5.
Figure 13:
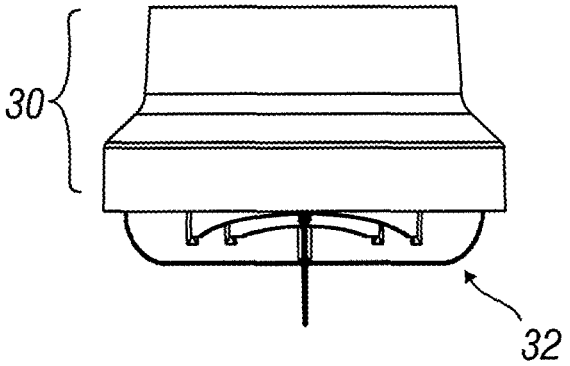
FIG. 13 shows a view from one side of the component in FIG. 12.
Figure 14:
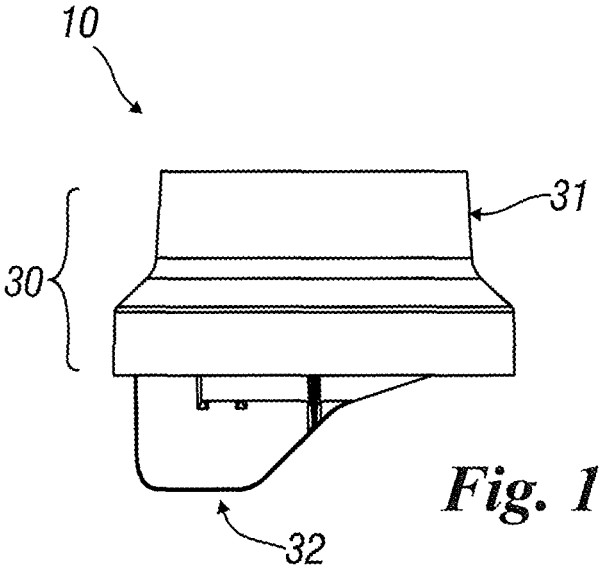
FIG. 14 shows a view from another side of the component in FIG. 12.

In a third embodiment shown in FIGS. 12-14 component or conveyor 10 still has a honeycomb structure 32 similar to that in the solution in FIGS. 9-11, but which projects less from shell 31 towards the inside of second hood portion 4. Also in this case honeycomb structure 32 is asymmetrical on the projecting part of shell 31, as in the other embodiments of component 10 already described.

Figure 15:
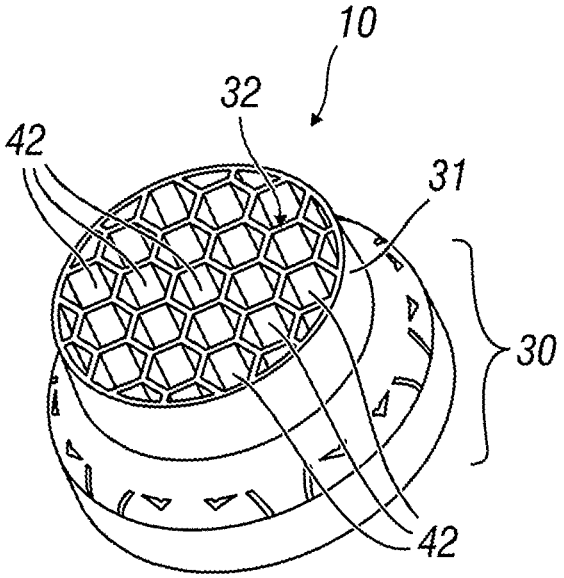
FIG. 15 shows a perspective view of a further variant of the component in FIG. 5.
Figure 16:
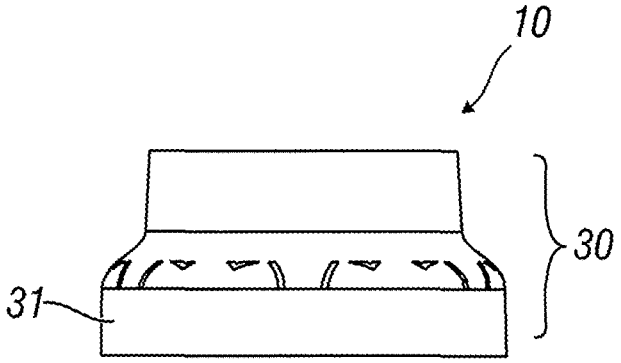
FIG. 16 shows a view from one side of the component in FIG. 15.

A further embodiment of conveyor 32 is shown in FIGS. 15 and 16 where, unlike the solutions already described, honeycomb structure 32 is within shell 31.

It should be noted that by honeycomb structure 32 is meant an element (of one piece with shell 31 or separate from it or inseparably attached to the shell) that has a plurality of adjacent channels having a parallel longitudinal axis. These channels are delimited by tubular cells 42 which may have a regular polygonal cross-section (as in FIG. 15) or an irregular one (as in FIG. 12). These tubular cells alternatively have different axial lengths on passing from one side of the structure 32 to the other (as in FIG. 5) or have identical axial lengths (as in FIG. 15). These tubular cells 42 can then project into second component 4 to guide the air moved by extraction device 6 to opening 20 of first hood portion 2.

In any event component or conveyor 10 improves the movement and direction of the air from the second hood portion to the first to avoid or at least limit dispersion of the air extracted by the hob into the environment. The air reaches body 16 where it expands (from the point of view of volume) before being expelled through fan 15; body 16 acts as a "stilling chamber" reached by all the air conveyed by component 10 to first portion 2, said body 16 holding back this air before it is discharged from the hood by fan 15.

Various embodiments of the invention have been described. However, yet others are possible and may be obtained from the teachings provided by the above description.

For example, body 16 is shown in the figures as a body with a circular cross-section; according to one variant this body may have a polygonal cross-section so as to facilitate positioning and securing of fan 15 on any side of this body.

These other solutions are also to be regarded as falling within the scope of the invention as defined by the following claims.

The invention claimed is:

1. An up-and-down extraction hood adapted to extract at least one of fumes or vapours generated from a hob, said hood comprising:

a first hood portion (2) adapted to be attached to a ceiling (3) of an environment in which the hob is placed, a second hood portion (4) spaced apart from the first hood portion (2) and adapted to be closer to the hob than the first hood portion, supports (5) that connect the first hood portion (2) to the second hood portion (4), a fan (6) in said second hood portion, the fan (6) adapted to extract air containing the at least one of fumes or vapours from the hob when the hood (1) is in use, said air being drawn in towards an opening (11) in said second hood portion (4) to be discharged therefrom and passed towards the first hood portion (2), the first hood portion (2) comprising a separate fan that draws in the air leaving the second hood portion (4) and extracted from the hob, a conveyor (10) provided at the opening (11) in the second hood portion (4) that is adapted to convey the discharged air towards the first hood portion, the conveyor (10) including a body (30) having a tubular annular shell (31) containing a honeycomb structure (32) with a plurality of tubular cells (42) through which the air leaving the second hood portion (4) is discharged, and wherein the honeycomb structure (32) has a first lateral side (39) that projects more from said shell (31) towards an inside of said second hood portion (4) than a second, opposite, lateral side (40), wherein the second lateral side (40) ends substantially within said shell (31) such that a free surface (38) of the honeycomb structure (32) extends in a curved course from outside the shell (31) to within the shell (31).

2. The up-and-down hood according to claim 1, wherein said tubular cells (42) defining the honeycomb structure (32) project from the shell (31) towards the inside of the second hood portion (4) with different lengths.

3. The up-and-down hood according to claim 2, wherein side panels (39, 40) of the honeycomb structure (32) form the first lateral side (39) and the second lateral side (40), the side panels (39, 40) having different axial lengths.

4. The up-and-down hood according to claim 1, wherein said tubular cells (42) have a transverse cross-section shaped as a regular polygon.

5. The up-and-down hood according to claim 1, wherein said tubular cells (42) have a transverse cross-section shaped as an irregular polygon.

6. The up-and-down hood according to claim 1, wherein said honeycomb structure (32) is formed in one piece with said annular tubular shell (31).

7. The up-and-down hood according to claim 1, wherein said honeycomb structure (32) is a separate element with respect to the tubular annular shell (31), and is attached to said tubular annular shell (31) with an interference fit.

8. The up-and-down hood according to claim 7, wherein said honeycomb structure comprises lateral tabs (33) inserted into seats (34) provided in the shell (31).

9. The up-and-down hood according to claim 1, wherein said first hood portion (2) comprises a hollow body (16) that receives the air leaving the second portion (4) and acts as a stilling chamber.

10. The up-and-down hood according to claim 9, wherein said hollow body (16) is externally associated with the separate fan (15) connected to a duct to discharge the air drawn in from the environment where the hood (1) is placed.

* * * * *